United States Patent [19]
Kosak
[11] 4,181,281
[45] Jan. 1, 1980

[54] ARTICULATED MULTI-SWIVEL CHAIR

[76] Inventor: Kerry D. Kosak, P.O. Box 905, Malibu, Calif. 90265

[21] Appl. No.: 965,999

[22] Filed: Dec. 4, 1978

[51] Int. Cl.² ..... A47C 3/18

[52] U.S. Cl. ..... 248/416; 108/140; 297/349

[58] Field of Search ..... 297/349; 248/416, 418, 248/417, 425, 282; 108/140, 142

[56] References Cited

U.S. PATENT DOCUMENTS

| | | | |
|---|---|---|---|
| 1,484,229 | 2/1924 | Miles | 108/140 |
| 3,708,203 | 1/1973 | Barecki et al. | 297/349 |
| 3,727,873 | 4/1973 | Hill | 297/349 |
| 4,023,760 | 5/1977 | Robinson | 248/416 |

*Primary Examiner*—Francis K. Zugel
*Attorney, Agent, or Firm*—McAulay, Fields, Fisher & Goldstein

[57] ABSTRACT

An articulated multi-swivel chair operable for access to stations disposed within a 360 degree circular range about the chair, includes a mechanism composed of at least two friction loadable pivots each supporting a corresponding link and, in combination, acting to support, with universal motion in two lateral axes, a chair body. Each of the pivots are preferably formed utilizing a tapered roller bearing or thrust bearing or bushing which are adjustable to provide a predetermined level of pivot friction by tightening an adjustment device such as an adjusting nut associated with each bearing. The first or lowest pivot is supported in a base which is of appropriate design to prevent tipping or which may be bolted or otherwise secured to the floor.

To prevent pivot lock-up and provide shock absorbtion when the links are fully extended, repulsion devices are provided in the links. These are preferably in the form of magnets being so located in the links as to have two magnet disposed in proximity to each other with like poles facing, i.e. when adjacent links are aligned.

9 Claims, 4 Drawing Figures 10
12
14
16
18
20
22
24
26A
26B
28
30
32
34
36
38
40
42
44
46
47
48
18A

ARTICULATED MULTI-SWIVEL CHAIR

BACKGROUND OF THE INVENTION

Articulated chairs operable to transport a user to portions disposed in a 360 degree circular range about the chair, utilizing a mechanism having two pivots, have been available for some time. Basically, these prior devices include a base portion having a pivot within which is supported a first link. The first link in turn includes a pivot in which a second link, including a support bushing for the chair body, is supported. The device utilizes ball bearings, which are non-adjustable bearing devices, in order to provide pivots with a minimum of friction. The resulting articulated chair device imparts a "floating feeling" to a person sitting in the chair body and is operable to transport the person anywhere within a 360 degree circular range defined by the extent of the mechanism.

The prior articulated chair permitted rapid and easy access to various "stations" or devices located within the 360 degree extent of its operating range. Because the prior mechanism was designed to provide apparently effortless motion, the "free floating" sensation which resulted from its use has been found "too free floating" by users whose need to move rapidly from station to station is limited. Attempts to add friction providing or loading devices to the prior chair have been unsuccessful mainly because the resulting mechanism will tend to "lock-up" when motion in certain directions is attempted. This occurs especially when the links are fully extended or are completely superimposed (aligned one above the other). The friction in the pivots tends to keep the links aligned, thereby causing radial thrust applied by the user to be ineffective to cause link rotation about the pivots. A noticable and annoying amount of movement or shifting about by the user of the device is required to "unlock" the mechanism and commence the relatively "free floating" action of the articulated chair.

A second, and related, disadvantage of the prior device is that, because only minimal friction is generated by the pivots, the device tends to be biased in a particular position when the total mechanism is not completely leveled. Thus, in the absence of a correcting or leveling device applied by the user, the chair will float to an equilibrium position. To overcome this requires that a technician familiar with the leveling mechanism spend time properly leveling the chair once it is placed in its final position. Further, moving the chair from the position for which it has been leveled may require a releveling operation if the floor is differently sloped.

It is therefore an object of the present invention to provide an articulated chair of the multi-swivel or multi-linkage type which provides an acceptable, and to some extent adjustable, "feel" or degree of friction with respect to the floating action of the chair.

It is a related object to provide a chair which, in general, can be delivered and set up without special leveling operations for most applications.

It is a still further object of the invention to avoid or substantially reduce the probability of "locking up" of the linkages, especially when they are fully extended or completely superimposed, in response to a radial thrust applied by the user of the chair.

BRIEF DESCRIPTION

The objects are accomplished by utilizing at least two pivots, one for each link, each of which pivot being supported in an adjustably loaded tapered roller or thrust bearing. Additionally, each pair of links carry facing repulsion magnets whereby when the pair of links are aligned, repulsion forces are generated therebetween which tend to bias the links out of alignment.

Thus, the use of adjustable thrust or tapered roller bearings permits introduction of a predetermined amount of friction at each pivot; while the use of repulsion magnets reduces the problem of "locking up" of the mechanism by biasing the links out of the configuration in which "locking-up" occurs.

DESCRIPTION OF THE PREFERRED EMBODIMENTS

Figures 1, 2, 3, 4:
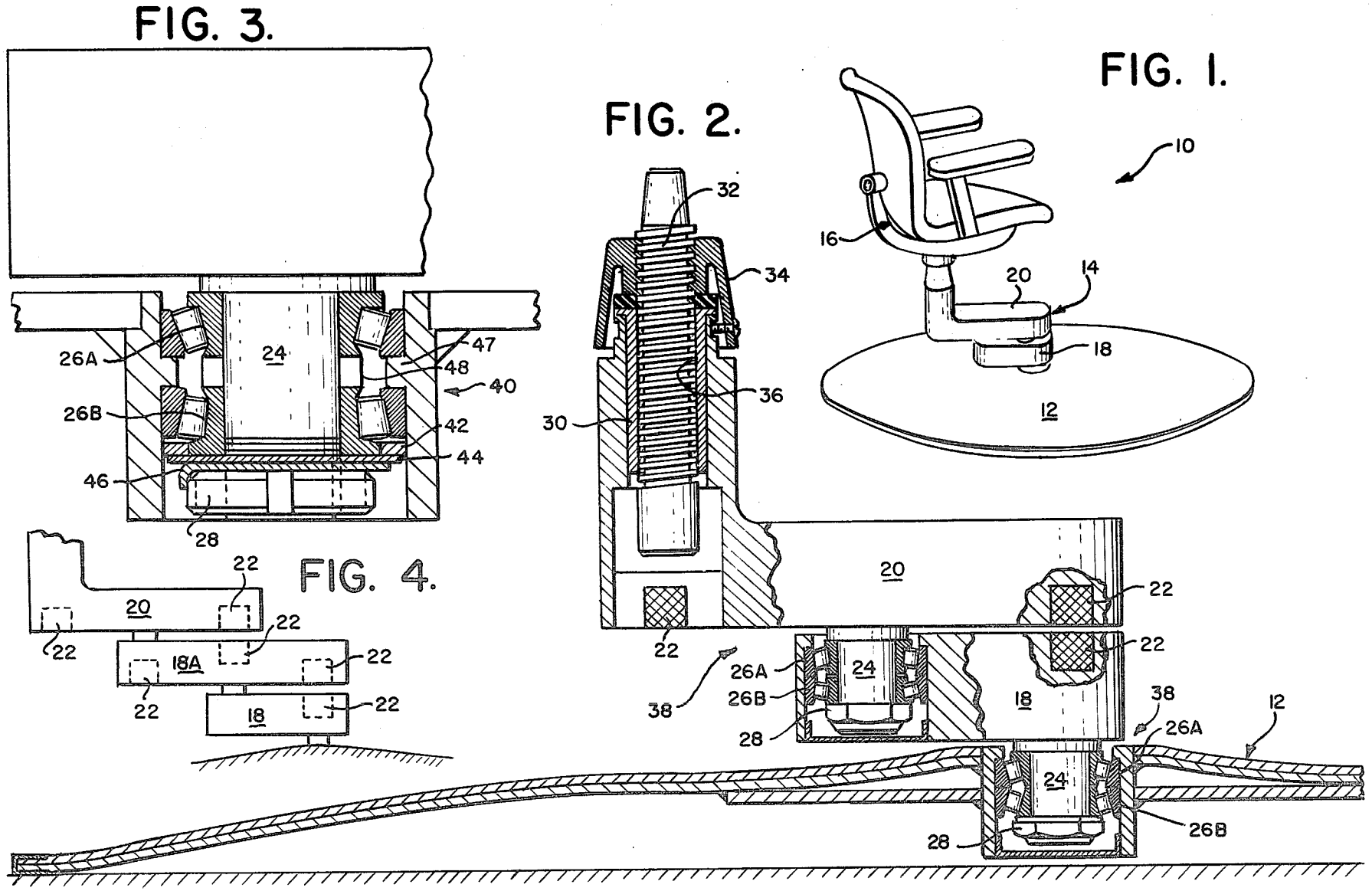
FIG. 1 is a perspective view of an articulated multi-swivel or multi-linkage chair according to the present invention, showing at least two links between the base and the chair body.
FIG. 2 is an enlarged partial view of the chair of FIG. 1, in section.
FIG. 3 is a detailed cross-sectional view of a preferred link embodiment which is a variation of the links of FIG. 2.
FIG. 4 is a diagrammatic illustration of a three link chair showing the relative position of the repulsion magnets.

As shown in FIG. 1, the general construction of the articulated multi-swivel and multi-link chair 10 of this invention includes a base 12 which rests on the floor and which supports a multi-link chair support mechanism 14 which, in turn, supports the seat body 16. The multi-link chair support mechanism 14 has at least two links, a lower link 18, and an upper link 20. The position of the chair 10 shown in FIG. 1 is one in which the chair body 16 is furthest removed from the central vertical axis of the base 12. This position is referred to herein as the extended position. In the extended position the links 18, 20, of the multi-link chair support mechanism 14, have the relationship shown in FIGS. 1 and 2.

As shown in FIG. 2, each link carrys a magnet 22. The inboard end of lower link 18, and the center of upper link 20 carry a downwardly extending spindle 24 which is threaded at its end to mate with a nut 28. Each spindle 24 is supported in upper and lower tapered roller bearings 26A and 26B. The nut 28 is threaded on the spindle 24. As the nut 28 is tightened, it bears against the inner race of the lower roller bearing 26B causing the rollers to ride inwardly slightly as they re-adjust between the inner and outer race. This increases the radial load of thrust, thereby increasing the amount of pivot friction. This tapered roller bearing, sometimes called a thrust bearing, thus provides a pivot mechanism 38 having an adjustably predetermined amount of pivot friction produced by tightening or loosening the adjustable nut 28.

In this fashion the inboard end of each link pivots in the link below it, with the lowest link 18 pivoting on the central axis of the base 12. Furthermore, each link supports the link above it with the base 12 supporting the lowest link 18 and the upper link 20 supporting the seat body 16.

More specifically, the outboard end of the upper link 20 carries a bushing 30 which receives a chair seat spindle mechanism 32 to support the seat body 16. The combination bushing 30 and seat spindle mechanism 32 may be any one of known types normally employed with business-type desk chairs and may include a height adjustment mechanism such as the combination of the adjusting member 34 carried by the bushing 30 and the threaded portion 36 of the seat spindle 32. This well-known combination allows the seat to be adjusted for height as well as to be rotatable about the axis of its support spindle 32.

The pivot 40 of FIG. 3 is generally similar in construction to the pivot 38 of FIG. 2 with some details of construction changed for ease of assembly. Thus, with reference to FIG. 3, each lower tapered roller bearing 26B is supported on a felt or similar material washer 42 which retains excess lubrication that might otherwise fall from the device. The felt washer 42 is, in turn, supported on a retaining washer 44, usually of metal or similar stiff material, which in turn is supported on a lock washer 46. This assembly is inserted over spindle 24, up against shoulder or lip 47 and secured in place by lock nut 28. The lock washer 46 restrains unintended or accidental rotation of the adjusting or loading nut 28.

A spacer washer 48, which can compress to allow the inner portions of the split roller bearing device 26A, 26B to be driven together by rotation of adjusting or loading nut 28, is provided between the portions 26A, 26B.

The upper roller bearing 26A is separately inserted from the top, and is supported on top of lip 47.

FIG. 4 shows a three link chair support mechanism composed of a lower link 18, an intermediate link 18A, and an upper link 20. The additional link 18A reduces the tendency of the multi-link chair support mechanism to "lock-up." Any number of additional links 18A can be inserted between the lower link 18 and the upper link 20, as desired.

Even with the three-link chair support mechanism arrangement, it has been found that some locking-up of the multi-link chair support mechanism occurs. In order to reduce the tendency of the mechanism to lock up, repulsion magnets are carried in each link. As can be seen in FIG. 2, the magnets 22 are carried near the extreme ends of each link in order to maximize the moment generated around the associated pivot 38. Magnets 22 in adjacent links are so disposed that at least one magnet in each link will be disposed adjacent to at least one magnet in an adjacent link when the links are aligned. The magnets are disposed with the same poles facing outwardly so that a repulsive force will be generated between adjacent magnets 22.

The links 18, 20 are preferably made of aluminum or non-magnetic steel, in order that they do not interfere with the repulsive effect of adjacent magnets. In practise, No. 5 ceramic magnets available in a standard size of one inch long by seven eights inches in diameter, have been found to generate sufficient repulsive forces, when one eighth inch or less clearance is used therebetween in adjacent links, to substantially prevent any lock-up in a two or three link multi-link chair support mechanism.

Although other magnets, such as magnets formed of Alnico, can be used, ceramic magnets have been found to have greater life and present no corrosion problems. In addition they are lighter in weight. However, if it is desired to use other magnets, or less powerful magnets, they may be employed although it may be found necessary to utilize larger magnets and/or more than one repulsive pair to obtain the desired effect.

The repulsive forces generated between adjacent magnets 22, also act as a shock absorbing means when the chair is forced outwardly, causing the multi-link chair support mechanism to be fully extended.

FIG. 4 shows a preferred arrangement of magnets when three links 18, 18A, 20 are employed. As would be obvious, the arrangement of links can be reversed so that the lowest link is long and the upper link is short and carries the chair support mechanism 16. The arrangement shown in FIG. 4 is preferred only in that it results in a more attractive looking chair device. Similarly, the links 18, 20 of FIG. 2, can be revised, with a shorted upper link carrying the chair and a longer lower link pivotably supported on the base 12.

OPERATION

To use an articulated multi-swivel chair in accordance with the present invention, one need only sit in the chair and move in the direction that it is desired to be transported by the chair. This will cause the chair body 16 apparently to float in the desired direction.

To control the "feel" or (drag) friction of the floating motion, adjusting or loading nuts 28 may be tightened or loosened thereby increasing or decreasing the amount of additional frictional forces generated in each pivot 38. These frictional forces increase the amount of effort necessary to change the position of the chair and thereby restrain any tendency of the chair to "float" to one position or another, when it is not otherwise held, due to a slightly sloping floor condition. Special leveling is thereby eliminated in usual applications.

Although two links 18, 20 are shown in the preferred embodiment of the drawings, any additional number of middle links 18A, as shown in FIG. 4, can be added simply by inserting them in an analogous manner to that shown in FIG. 4. Of course, if a non-secured base is used, such as the base 12 shown in the drawings, it will have to be properly dimensioned to avoid tipping of the chair by compensating for the additional range of travel due to additional links.

The preferred pivot arrangement shown in FIG. 3 can be substituted for the pivots shown in FIGS. 2 or 4.

The use of a lock washer 46, as shown in FIG. 3, helps restrain changes in adjustment by preventing accidental rotation of nut 28. It can, of course, be used in the pivot 38 of FIG. 2 just as effectively. This is also true of the lubrication retaining felt or cloth washer 42, the retainer washer 44, and the spacer washer 48.

Each of the pivots or pivot mechanisms must incorporate the friction adding features, as otherwise the chair will freely swivel about the low friction pivot mechanism thereby partially defeating the objects of the invention.

The repulsive magnets 22 bias the links 18, 20 out of alignment, thereby reducing or eliminating any lock-up in the multi-link chair support mechanism. These magnets are particularly important when the pivots have been friction loaded.

While preferred embodiments have been shown and described herein, it will be realized that this is for the purposes of illustration, and the invention should not be considered as limited except in accordance with the appended claims.

What is claimed is:

1. In an articulated multi-swivel chair of the type having a base, an articulated support mechanism, and a chair body, the improvement comprising:

said articulated support mechanism including at least two links and two pivots, each of said pivots having a friction loadable bearing and means for adjusting the load on said bearing to provide a predetermined magnitude of frictional force within each pivot, and an anti-alignment device associated with said links and generating repulsive forces between adjacent of said links when said links are aligned, to bias said links out of alignment.

2. The chair of claim 1 wherein said loadable bearing comprises an adjustable thrust or tapered roller bearing, and said repulsion device is composed of magnets.

3. The chair of claim 1 wherein there are three links and three pivots.

4. The chair of claim 1 wherein said anti-alignment device comprises two repulsion magnets, one disposed in an end portion of a first said link and the other disposed in an end portion of a second said link, like poles of said magnets facing outwardly of their associated links to generate a repulsion force between said links when said links are aligned with the magnets adjacent each other.

5. In a chair having a base, a seat body on a swivel bushing, and a support mechanism between said base and said swivel bushing, the support mechanism comprising:

two articulated links arranged in a sequential fashion one above the other between said base and said swivel bushing, a first link pivot mechanism coupling said links to each other, and a second link pivot mechanism coupling the lower link to said base, each of said link pivot mechanisms including a bearing device adjustable to provide a predetermined level of pivot friction, a first magnet carried by a first said link a predetermined distance from said first pivot mechanism, and disposed with a predetermined magnetic pole near the second link when said links are aligned, a second magnet carried by a second said link, said predetermined distance from said first pivot mechanism, and disposed with its said predetermined magnetic pole near said first link when said links are aligned, thereby to generate repulsive magnetic forces between said links when said links are aligned.

6. The chair of claim 5 wherein each said pivot mechanism comprises an adjustable thrust or tapered roller bearing.

7. The chair of claim 5 or 6, wherein said second link includes an extension extending at least said predetermined distance beyond said first pivot whereby said first link has two positions of alignment above said second link, said positions being rotatably spaced apart 180° about said first link, further comprising, a third magnet carried by said extension said predetermined distance from said first pivot with its said predetermined magnetic pole near said first link when said links are aligned, thereby to generate repulsive magnetic forces between said links when said links are aligned in either aligned position.

8. The chair of claim 6 wherein each said pivot mechanism further comprises an adjusting nut to adjust the level of pivot friction and a lock washer to restrain rotation of said nut after adjustment.

9. The chair of claim 7 wherein each said pivot mechanism further comprises a lubrication retaining means to retain excess lubrication from said bearing, a retainer washer to support said lubrication retaining means, said lubrication retaining means and said retainer washer being supported by said adjusting nut.

* * * * *

UNITED STATES PATENT AND TRADEMARK OFFICE

CERTIFICATE OF CORRECTION

PATENT NO. : 4,181,281

DATED : January 1, 1980

INVENTOR(S) : Kerry D. Kosak

It is certified that error appears in the above-identified patent and that said Letters Patent are hereby corrected as shown below:

Column 6, line 17 (claim 7, line 3) change "first" (second occurrence) to -- second --;

Column 6, line 18 (claim 7, line 4) change "second" to -- first --;

Column 6, line 20 (claim 7, line 6) change "link" to -- pivot --.

Signed and Sealed this

*Twenty-fourth* Day of *June 1980*

[SEAL]

*Attest:*

SIDNEY A. DIAMOND

*Attesting Officer*

*Commissioner of Patents and Trademarks*